United States Patent [19]

Huss

[11] 4,230,404

[45] Oct. 28, 1980

[54] DEVICE FOR THE CONTINUOUS DEVELOPING OF BAND- AND SHEET-SHAPED PHOTOGRAPHIC LAYER CARRIERS

[76] Inventor: Heinrich Huss, Liebigstrasse 1, 6054 Rodgau 6, Fed. Rep. of Germany

[21] Appl. No.: 940,858

[22] Filed: Sep. 8, 1978

[30] Foreign Application Priority Data

Sep. 9, 1977 [DE] Fed. Rep. of Germany ..... 2740650
May 24, 1978 [DE] Fed. Rep. of Germany ..... 2822677

[51] Int. Cl.[3] ..... G03D 3/13

[52] U.S. Cl. ..... 354/321; 354/322; 134/64 P; 226/189

[58] Field of Search ..... 354/298, 312, 313, 314, 354/316, 319, 320, 321, 322; 134/64 P, 122 P; 226/113, 118, 181, 186, 189

[56] References Cited

U.S. PATENT DOCUMENTS

| | | | |
|---|---|---|---|
| 3,345,928 | 10/1967 | Krehbiel | 354/316 |
| 3,366,025 | 1/1968 | Layne | 226/189 |
| 3,561,344 | 2/1971 | Frutiger | 354/298 |
| 3,760,705 | 9/1973 | Miller | 354/322 |
| 3,989,176 | 11/1976 | Hope et al. | 226/189 |
| 4,002,280 | 1/1977 | Coleman et al. | 354/319 |
| 4,034,389 | 7/1977 | Huss | 354/316 |
| 4,072,061 | 2/1978 | Calfisch | 354/321 |

*Primary Examiner*—John Gonzales
*Assistant Examiner*—Alan Mathews
*Attorney, Agent, or Firm*—Michael J. Striker

[57] ABSTRACT

This photographic developing apparatus transports strip or sheet film through a plurality of baths. The film is transported in each bath in loop formation between three rows of rollers with the rollers in the middle row having larger diameters than the rollers in the outer rows. Between each bath is a transfer device including a receptacle of fluid and a transfer roller dipping into the receptacle. Deflector rollers arranged in an arc loosely rest on top of the transfer roller. One row of guide rollers arranged at the outlet side of the bath container adjacent the upper roller of the middle row. The guide rollers are driven by the upper middle roller. The last two guide rollers form an outlet gap for the film.

4 Claims, 3 Drawing Figures

DEVICE FOR THE CONTINUOUS DEVELOPING OF BAND- AND SHEET-SHAPED PHOTOGRAPHIC LAYER CARRIERS

The invention relates to an arrangement for the pass-through development of band- or sheet-shaped photographic layer carriers with devices for transporting the layer carrier through several bath containers which are arranged behind one another in pass-through direction and in which the layer carrier is advanced between three rows of rollers under loop formation, the diameter of the rollers in the middle row being greater than in the two outer rows, with an infeed device ahead of the first bath container and with respective transfer devices between two bath containers which include a driven transfer roller which dips into a receptacle and at least one non-driven deflecting roller loosely resting on the transfer roller under its own weight.

The transfer device of a prior art arrangement was constructed in the conventional manner, analogously known from U.S. Pat. No. 3,561,344.

Experience has shown that the angle of contact between the front edge of a layer carrier which freely rises from a bath container without guide baffles, and the transfer roller of the transfer device is not always optimal because the inherent curvature of wet layer carriers differs in dependence upon the type so that the leading edge may deviate from the theoretical path curve, and particularly because no pass-through gap is set and maintained between the rollers of the transfer device—as is the case in the deflecting device—but instead the deflecting rollers rest on the transfer roller under their own weight.

The task of the invention is to improve the entry of the layer carrier into the transfer device by measures at the outlet side of the transporting device of the bath container, and on the transfer device itself, without increasing the set of structural elements.

This task is solved in that at the outlet side of a bath container, adjacent the upper roll of the middle row, a row of guide rollers is arranged which are driven by the upper roll and of which the two guide rollers which come last in transport direction from an outlet gap for the layer carrier, and in that the deflecting rollers of the transfer device are arranged in a dense annulus and their diameter is substantially smaller than the diameter of the transfer roller.

The guide rollers substantially shorten the free path up to the transfer device and prevent indeterminate lateral deviation of the layer carrier. The layer carrier is gently guided by the multiplicity of deflecting rollers of substantially smaller diameter which rest on the transfer roller in a dense annulus. Although the transportation path in the transfer device is not located in a liquid, the layer carrier is nevertheless still moist and is constantly wetted by the transfer roller which dips into a cleaning bath.

In a preferred embodiment of the invention the guide rollers of the bath container are coupled with one another and their lowermost one, respectively the one of them which is first in transporting direction, is coupled with the upper middle roller so that a drive train is formed.

The transfer roller and the deflecting rollers of the transfer device advantageously have the same diameters as the rollers of the middle row, respectively of the outer rows, in the bath container. The diameter ratio may be between 4:1 and 5:1. In this manner only two roller sets are needed, which further simplifies and reduces the cost of the set of structural elements for the complete arrangement.

In further development of the invention the deflecting rollers are journalled in the end walls of a frame for radial shifting in direction towards the axis of the transfer roller, and the frame is in turn mounted vertically shiftable on the container of the transfer device, respectively on the frame of the arrangement. In this manner the play between the rollers—and thus the contact pressure—can be exactly set in a simple manner.

In the following the invention will be explained in more detail with reference to an exemplary embodiment which is shown in the drawing. The latter shows in schematic illustration, in FIG. 1 a side view of the transporting device of a bath container and the thereafter following transfer device with container whose side walls are removed;

Figure 1:
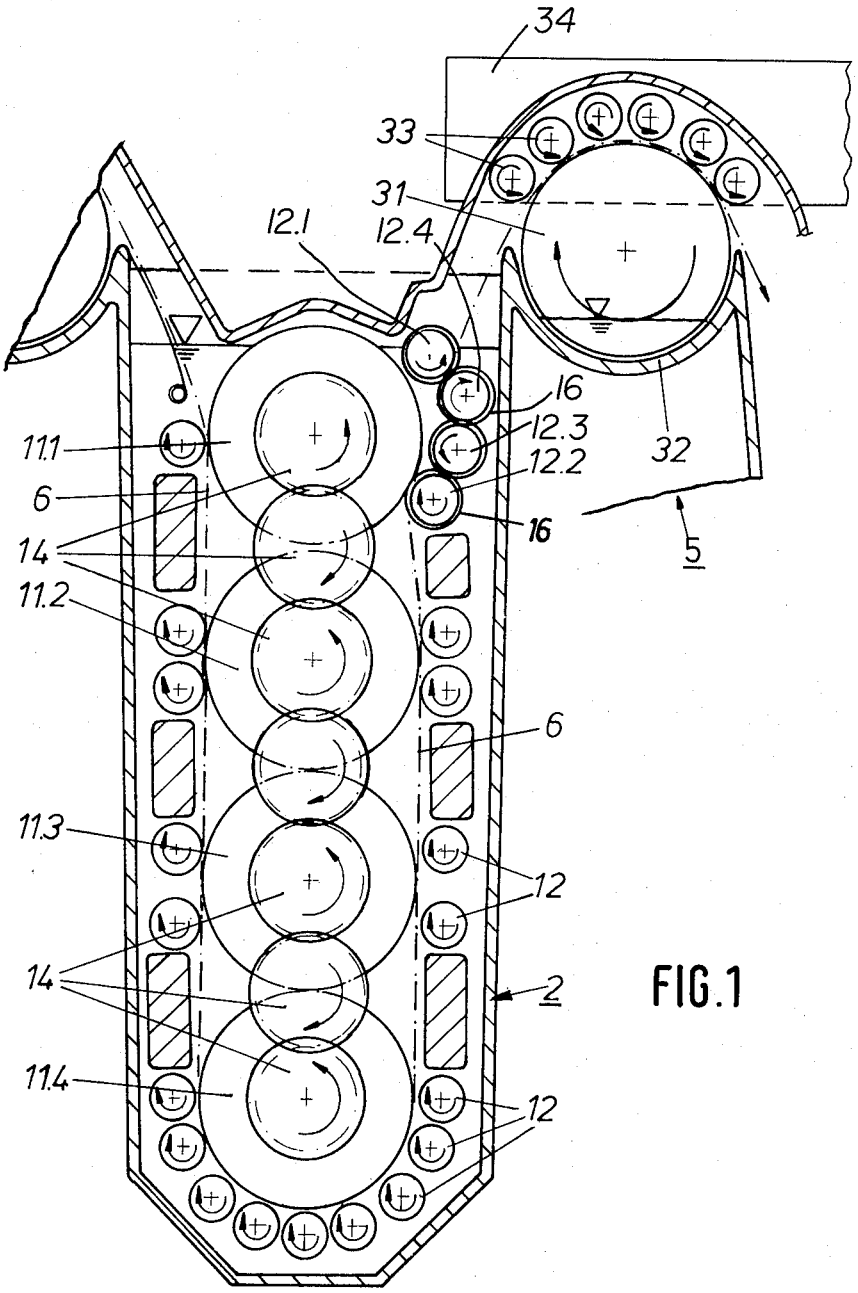
FIG. 1 shows a single bath container 2 with the thereafter following transfer device 5 and its transporting device, on a lifesize scale and with removed container side wall.

The transporting device in the bath container consists of three vertical rows of rollers 11, 12 which are arranged above one another. In this embodiment the middle row container e.g. four rollers 11.1 to 11.4 of large diameter, of which the lower roller 11.4 has the function of a deflecting roller. The two outer rows contain a total of 23 rollers 12 of small diameter. The diameter ratio of the two roller types is about 4:1. The rollers of adjacent rows are spaced from one another by 0.8 to 1 mm.

The small outer rollers 12 are coupled with the large middle rollers via meshing pinions 16 out of which engages with the roller 11.1. For clarity this is shown only for the guide roller set of four small rollers 12.1 to 12.4 which is associated with the upper middle roller 11.1 at the outlet side of the layer carrier 6. The special aspect is that only the lowest roller 12.2 is coupled with the middle roller 11.1, whereas it forms a drive train with the outer roller of its set.

The transfer device consists of a container 32 filled with fresh water, in which a transfer roller 31 is journalled. The container contents are constantly replenished via a (not illustrated) supply and the water level is maintained constant by an overflow (also not illustrated) in known manner. A set of deflecting rollers 33 is provided above the transfer roller 31 in a dense annulus, in such a manner that the rollers follow each other almost without spacing. These deflecting rollers 33 rest under their own weight on the transfer roller 31. Due to this the layer carrier is guided (at almost constant curvature) in a loop about the transfer roller 31 and out of the transfer device (into the next bath container or into a dryer) in downwardly inclined direction.

The transfer roller 31 is driven synchronously with the large rollers 11 of the middle row, which are coupled with one another by a set of gears 14. Therefore the transfer roller 31 continues to turn subsequent to passage of a layer carrier 6 and is not only constantly being cleaned in the container both, but also itself cleans the deflecting rollers 33.

The axis of the lowest roller 12.2 of the guide roller set is located lower than the axis of the middle roller 11.1. The purpose of this is to initiate the deflection of the rising section of the layer-carrier loop already within the bath, respectively within the bath container 2. If the layer carrier 6 is deflected too much, then it is guided in a friction-free manner by one of the higher small rollers 12.3 or 12.4 which are also driven. Finally, the layer carrier 6 issues from the bath container 2 through a gap formed by the roller pair 12.1, 12.4. This assures that the layer carrier will properly enter into the gap formed between the transfer roller 31 and the first deflecting roller 33 of the deflecting roller set arranged above the same, and that it does not impinge upon the transfer roller 31 under a more or less steep angle.

Figure 2:
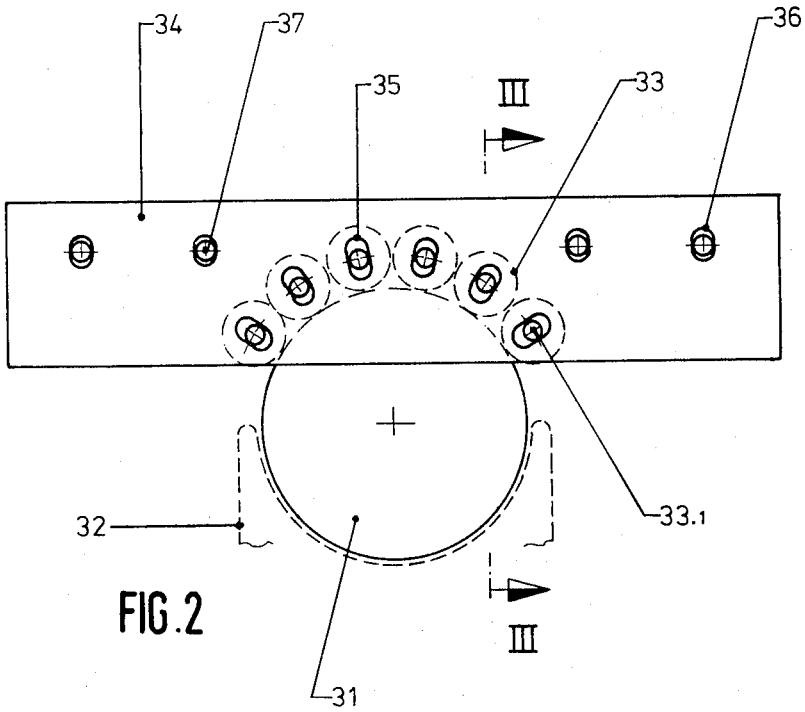
FIG. 2 is a side view of the frame in which the deflecting rollers of the transfer device are shiftably journalled.
Figure 3:
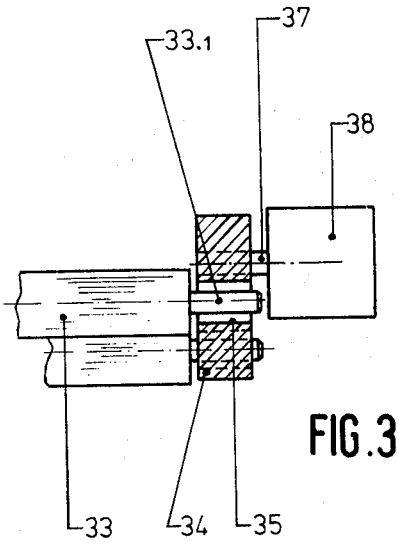
FIG. 3 a cross-section through the frame of FIG. 2 on line III—III.

FIGS. 2 and 3 show an example for the yieldable journalling of the deflecting rollers 33 in a frame 34. The two shafts 33.1 are journalled in slots 35 in the end walls 34.1 of the frame 34; the elongation of the slots is directed towards the axis of the transfer roller 31 journalled in the container 32. The frame 34 is in turn mounted via vertical slots 36 in its end walls 34.1 on bolts 37 which are secured in consoles 38 (not shown in detail). One can see that the set of rollers in toto, and the deflecting roller 33 separately, can adjust themselves with two degrees of freedom to the circumference of the transfer roller 31, which is necessary so that the permissible contact pressure will not be exceeded at any location.

Details of the invention may be modified. Thus, the number of deflecting rollers 33 and the sector angle of the transfer-roller circumference which is covered by them, can be accommodated to the dimensions of the arrangement. In place of the slots 35, 37 round holes may be provided which afford the necessary play to the roller shaft 33.1 respectively to the bolts 37.

I claim:

1. Arrangement for the pass-through development of band- or sheet-shaped photographic layer carriers, having devices for transporting the layer carrier through several bath containers arranged successively in pass-through direction and between each two of which a receptacle of fluid is located, the layer carrier being advanced in the pass-through direction under loop formation between three rows of rollers whose diameter in the middle row is substantially greater than in the outer rows, with an infeed device ahead of the first bath container and with a plurality of transfer devices each located between each two bath containers and each transfer device including a driven transfer roller dipping into the receptacle of fluid and at least one non-driven deflecting roller resting loosely on the transfer roller under its own weight, wherein the improvement comprises that one of said rows of rollers includes a row of guide rollers arranged at the outlet side of a bath container adjacent the upper roller of the middle row, said guide rollers being driven by said upper roller of said middle row, and the last two guide rollers in the transport direction of said row of guide rollers forming an outlet gap for the layer carrier, the deflecting rollers of the respective transfer device being arranged in an arc and their diameters being substantially smaller than the diameter of the transfer roller; a frame having end walls in which said deflecting rollers are journalled for radial shifting towards the axis of the transfer roller; and means mounting said frame vertically shiftable on the arrangement.

2. Arrangement for the pass-through development of band- or sheet-shaped photographic layer carriers, having devices for transporting the layer carrier through several bath containers arranged successively in pass-through direction and between each two of which a receptacle of fluid is located, the layer carrier being advanced in the pass-through direction under loop formation between three rows of rollers whose diameter in the middle row is substantially greater than in the outer rows, with an infeed device ahead of the first bath container and with a plurality of transfer devices each located between each two bath containers and each transfer device including a driven transfer roller dipping into the receptacle of fluid and at least one non driven deflecting roller resting loosely on the transfer roller under its own weight, wherein the improvement comprises that one of said rows of rollers includes a row of guide rollers coupled to one another and arranged at the outlet side of a bath container adjacent the upper roller of the middle row, the last two guide rollers in the transport direction forming an outlet gap for the layer carrier, means coupling at least one of said guide rollers in motion-transmitting relationship with said upper roller of said middle row so that said guide rollers are driven by said upper roller, said deflecting rollers of the respective transfer devices being arranged in an arc and their diameters being substantially smaller than the diameter of the transfer roller.

3. Arrangement according to claim 2, wherein the transfer rollers have the same diameter as the rollers of said middle row, and the deflecting rollers have the same diameters as the rollers of the outer rows.

4. Arrangement according to claim 3, wherein the diameter ratio between said transfer rollers and said deflecting rollers is between 4:1 and 5:1.

* * * * *